United States Patent [19]

Callicott et al.

[11] 4,396,522

[45] Aug. 2, 1983

[54] POLYETHYLENE OXIDE CAKE WITH REDUCED GELLING FOR FLUSH TOILET WASTEWATER SANITATION

[75] Inventors: Robert H. Callicott, West Chester; Stephen H. Iding, Cincinnati, both of Ohio

[73] Assignee: The Proctor & Gamble Company, Cincinnati, Ohio

[21] Appl. No.: 263,315

[22] Filed: May 13, 1981

[51] Int. Cl.[3] ..... C11D 3/37; C11D 13/18; C11D 7/60

[52] U.S. Cl. ..... 252/163; 252/170; 252/171; 252/174; 252/174.21; 252/174.23; 252/106; 252/DIG. 2; 252/DIG. 16

[58] Field of Search ..... 252/DIG. 2, DIG. 16, 252/174, 174.21, 174.22, 174.23, 550, 553, 554, 558, 559, 106, 163, 170, 171, 99

[56] References Cited

U.S. PATENT DOCUMENTS

| | | | |
|---|---|---|---|
| 3,331,780 | 7/1967 | Krusius | 252/135 |
| 3,897,357 | 7/1975 | Carmello et al. | 252/106 |
| 3,936,385 | 2/1976 | Cheng | 252/99 |
| 3,944,663 | 3/1976 | Weiss et al. | 252/DIG. 2 |
| 3,959,176 | 5/1976 | Mahn et al. | 252/352 |
| 4,148,743 | 4/1979 | Schubert | 252/132 |
| 4,169,067 | 9/1979 | Joshi | 252/174.21 |
| 4,240,919 | 12/1980 | Chapman | 252/99 |
| 4,246,129 | 1/1981 | Kacher | 252/174 |
| 4,284,534 | 8/1981 | Ehrlich | 252/550 |
| 4,310,434 | 1/1982 | Choy et al. | 252/174 |

FOREIGN PATENT DOCUMENTS

| | | |
|---|---|---|
| 279057 | 2/1970 | Fed. Rep. of Germany . |
| 2279964 | 2/1976 | France . |
| 53-58507 | 5/1978 | Japan . |
| 989683 | 4/1966 | United Kingdom . |

OTHER PUBLICATIONS

Union Carbide Corporation, "How to Dissolve Polyox ® Water-Soluble Resins," Bulletin 40246-C, Jan. 1964.

Union Carbide Corporation, No. 38, 1964, "Polyox Water-Soluble Resins", Bulletin F-40246-C, Jan. 1964, pp. 5, 6.

*Primary Examiner*—John E. Kittle
*Assistant Examiner*—Hoa Van Le
*Attorney, Agent, or Firm*—Richard C. Witte; Ronald L. Hemingway; Leonard Williamson

[57] ABSTRACT

Solid cake compositions comprising three essential components: polyethylene oxide resin, a nonsolvent resin coating liquid, preferably a perfume, and a surfactant. The components are mixed to form an extrudable mass and the mass is extruded into a log. The log is then cut or sliced into individual cakes. The compositions have reduced gelling characteristics, which reduce the tendency of the resin to form a gel when the cake is contacted with water. The cakes are useful in dispensers which are employed in the flush tank of a toilet to automatically dispense chemicals to the flush water. The polyethylene oxide resin dispensed into the wastewater minimizes aerosolization of the wastewater which occurs when the toilet is flushed.

22 Claims, 1 Drawing Figure

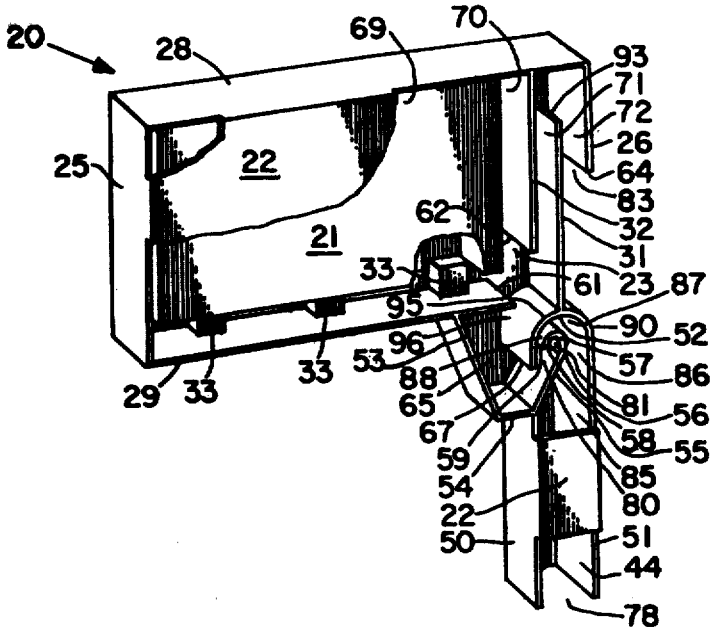
20
28
69
70
93
71
72
26
64
83
32
31
25
22
21
62
33
61
23
87
95
90
52
96
57
53
86
88
81
56
65
58
55
67
59
85
54
80
22
51
50
44
78
29
33
33

POLYETHYLENE OXIDE CAKE WITH REDUCED GELLING FOR FLUSH TOILET WASTEWATER SANITATION

TECHNICAL FIELD

The present invention relates to polyethylene oxide cake compositions which are useful for the treatment of the flush water of toilets in order to reduce the tendency of such flush water to produce aerosolization during the flushing. The compositions comprise a polyethylene oxide resin, a nonsolvent resin coating liquid and a surfactant, and are formulated so as to avoid excessive amounts of gelling when used in certain types of dispensing means for automatic dispensing of chemicals into the toilet flush tank.

BACKGROUND ART

The reduction of aerosolization produced by the flushing of toilets is desirable in order to reduce the possibility of airborne transmission of organisms from the toilet wastewater. In the application of MuCune, U.S. Ser. No. 959,405, filed Nov. 9, 1978, now abandoned in favor of continuation-in-part application which issued as U.S. Pat. No. 4,253,951 on Mar. 3, 1981, and is incorporated by reference herein, it is disclosed that the aerosolization of wastewater from flushing toilets can be significantly reduced by the presence of low levels (1-30 ppm) of high molecular weight polyethylene oxide resins in the wastewater.

In treating toilet flush water with chemicals in order to produce desirable effects such as bowl cleaning, it is desirable that the chemicals be dispensed into the flush water automatically each time the toilet is flushed. The prior art discloses numerous devices which have been designed for this purpose. Exemplary of such devices are those disclosed in U.S. Pat. Nos. 3,831,205, issued Aug. 27, 1974, to Foley; 3,341,074, issued Sept. 12, 1967, to Pannutti; 3,504,384, issued Apr. 7, 1970, to Radley et al.; 2,688,754, issued Sept. 14, 1954, to Willits et al.; and 4,036,407, issued July 19, 1977, to Slone. Particularly desirable devices are those wherein the chemical composition is in the device in the form of a solid cake composition. In this type of device a measured amount of water enters the device during one flush cycle and remains in contact with the cake composition between flushes, thereby forming a concentrated solution of the composition which is dispensed into the flush water during the next flush. The advantages of such devices are that the chemical composition can be packaged and shipped in more concentrated form than an aqueous solution of the chemicals, and the problems of liquid spillage resulting from breakage of the dispensers during shipment or handling are eliminated. Exemplary devices for automatic dispensing of chemicals from solid cake compositions into the toilet are those described in U.S. Pat. Nos. 4,171,546, issued Oct. 23, 1979, to Dirksing, 4,208,747, issued June 24, 1980, to Dirksing; and 4,186,856, issued Feb. 5, 1980, to Dirksing. A dispensing means for use with the compositions herein is described in the application of Choy entitled "PASSIVE DOSING DISPENSER EXHIBITING IMPROVED RESISTANCE TO CLOGGING", U.S. Ser. No. 153,997, filed May 28, 1980. All of said patents and applications being incorporated herein by reference.

It has been found that when solid cake compositions comprising high molecular weight polyethylene oxide resins (i.e., molecular weights of from about 500,000 to 7,000,000) are utilized in automatic dispensers, the resin forms a thick gel when exposed to the limited volume of water within the dispenser, thereby retarding or even completely blocking the subsequent flow of dissolved materials out of the dispenser and into the flush water. In the application of Choy et al., U.S. Ser. No. 153,993, filed May 28, 1980, it is disclosed that the resin gelling problem is avoided by resin compositions comprising PEO resin, surfactant and water-soluble salts. The Choy et al. compositions, however, are difficult to manufacture using conventional bar soap extruders and related cake cutting or stamping equipment. The Choy et al. composition cakes must be formed by high pressure tableting equipment.

It is an object of the present invention to provide solid cake compositions comprising polyethylene oxide resins, which compositions are suitable for use in dispensers for automatically dispensing chemicals into the toilet.

It is a further object of the present invention to provide solid cake compositions comprising polyethylene oxide resins which compositions have a reduced tendency to form gels when exposed to water.

Yet another object of the present invention is to provide a composition which can be extruded into a bar and the bar cut into solid cakes.

SUMMARY OF THE INVENTION

The present invention relates to solid cake compositions having reduced gelling characteristics.

The compositions comprise:

(A) from about 5% to about 20% of a polyethylene oxide resin having a molecular weight of from about 500,000 to about 7,000,000;

(B) from about 1.5% to about 30% of a nonsolvent coating liquid in a weight ratio of from about 0.3:1 to about 1.5:1 of said coating liquid to said resin;

(C) from about 40% to about 93.5% of a surfactant which is substantially solid at about 25° C. to about 50° C., preferably about 38° C.; and wherein said coating liquid does not significantly solubilize said resin at said temperatures; and the resin when coated with said coating liquid remains free-flowing and a mixture of A, B and C is extrudable at said temperatures.

DISCLOSURE OF INVENTION

According to the present invention it has been found that by combining polyethylene oxide resins (hereinafter also referred to as PEO resins) with certain types of nonsolvent liquid coatings and surfactants in certain proportions, compositions are obtained wherein the tendency of the resin to gel upon exposure to water is greatly reduced, thereby facilitating the dispensing of said resins into toilet flush water from automatic dispensing devices.

The compositions of the present invention are in the form of solid cake matrices and comprise:

(A) from about 5% to about 20% of a polyethylene oxide resin having a molecular weight of from about 500,000 to about 7,000,000;

(B) from about 1.5% to about 30% of a nonsolvent coating liquid in a weight ratio of from about 0.3:1 to about 1.5:1 of said coating liquid to said resin;

(C) from about 40% to about 93.5% of a surfactant which is substantially solid at about 25° C. to about 50° C., preferably about 38° C.; and wherein said coating liquid does not solubilize said resin at said temperatures; and the resin when coated with said coating liquid remains free-flowing and a mixture of A, B and C is extrudable at said temperatures.

All percentages and ratios recited herein are "by weight" unless otherwise specified.

The resin in the compositions herein when present in the wastewater of a toilet bowl at levels of at least about 0.1 ppm or more, preferably greater than about 1 ppm, and most preferably about 4 to 15 ppm, significantly reduces the tendency for aerosol formation during the flushing of the toilet. The organic nonsolvent coating liquid reduces gelling of the resin in the dispensing device from which a concentrated solution of the resin is advantageously dispensed into the toilet tank flush water. It is believed that the coating liquid operates by dispersing the resin in the matrix, and thereby suppressing gelation of the resin upon contact with water. The applicants are not, however, relying on this theory or belief. The surfactant is believed to provide controlled solubilization of the coated-dispersed resin. When the resin is combined with the coating liquid and surfactant in the manner described herein, a composition is obtained which provides sufficient solubilization of the resin to produce the required concentration of resin in solution for dispensing into the flush water, and at the same time avoids excessive gelling of the resin, which can clog the dispenser used for automatically dispensing the solution of resin into the flush water.

The polyethylene oxide resins of the present invention are polymers of ethylene oxide having average molecular weights of from about 500,000 to 7,000,000. The preferred molecular weight range is from about 1,000,000 to about 7,000,000. These polymeric resins are commercially available under the trade name POLYOX from Union Carbide Corporation. They can be prepared by the polymerization of ethylene oxide, utilizing an alkaline earth metal oxide as catalyst. The amount of PEO resin in the compositions herein can be from about 5% to about 20%, preferably from about 8% to 16%, and 10% to 12%.

THE NONSOLVENT RESIN COATING LIQUID

The nonsolvent resin coating liquids used in the present invention are organic liquids which do not substantially solubilize the resin at 25° C. to 50° C., preferably 38° C., in the cakes of this invention, but, rather, coat the resin in those cakes to resist and control gelling when the cake is in contact with water. The resin coated with the liquid (using the percentages and ratios disclosed herein) should remain free-flowing and the composition mixture, including the surfactant, must be extrudable to form a log from which solid cake matrices are cut. The preferred coating liquids are perfumes and light oils which are insoluble in water. The most preferred liquids are perfumes. The coating liquids are used in the compositions herein at levels of from about 1.5% to about 30%, and preferably at ratios of from about 0.3:1 to 1.2:1 coating liquid to resin. Examples of preferred coating liquids are perfumes selected from isobornyl acetate, myrtenyl acetate, and fenchyl acetate and mixtures thereof. Selected perfume grade materials have been evaluated for PEO solubilization at room temperature and at a 1 to 1 ratio of PEO to perfume material. The perfume materials listed in Table I have been judged satisfactory (i.e., the perfume/resin mix was not sticky) while those in Table II would be unacceptable when used alone or as a major portion of the finished perfume at the ratio of 1:1.

TABLE I

| |
|---|
| Amyl Cinnamic Aldehyde |
| Anisic Aldehyde |
| Benzyl Acetate |
| Beta Pinene |
| Citrathal (trade name)[1] |
| Diphenyl Oxide |
| Dodecalacetone |
| Gamma Methyl Ionone |
| Geranyl Nitrile |
| Isobornyl Acetate |
| Isocyclo Citral |
| Labdanum Claire |
| Ligustral (trade name)[2] |
| Methyl Nonyl Acetaldehyde |
| d'-Limonene |
| Patchouli (natural oil) |
| 4-tertiary Butyl Cyclohexyl Acetate |
| Tri-Cyclo Decenyl Propionate |

[1]Proprietary Perfumes Ltd. (England)
[2]Naarden (Holland)

TABLE II

| |
|---|
| Carvacrol |
| Eugenol |
| Hexanoic Acid |
| Phenyl Ethyl Alcohol |
| Thymol |

Perfumes are complex compositions. Table III shows two acceptable perfumes useful in the practice of the present invention.

TABLE III

| Perfume Formulas | |
|---|---|
| Component | Weight % |
| 1-A | |
| Iso Bornyl Acetate | 31.0 |
| d' Limonene | 20.0 |
| 4-Tertiary Butyl Cyclohexyl Acetate | 5.0 |
| Tricyclo Decenyl Propionate | 5.0 |
| Amyl Cinnamic Aldehyde | 8.0 |
| Anisic Aldehyde | 3.0 |
| Iso Cyclo Citral | 1.0 |
| Methyl Nonyl Acetaldehyde | 1.0 |
| Citrathal | 3.0 |
| Benzyl Acetate | 10.0 |
| Patchouli | 3.0 |
| Beta Pinene | 1.0 |
| Diphenyl Oxide | 2.0 |
| Gamma Dodecalactone | 0.5 |
| Delta Undecalactone | 0.5 |
| Gamma Methyl Ionone | 1.0 |
| Geranyl Nitrile | 2.0 |
| Labdanum Claire | 2.0 |
| Ligustral | 1.0 |
| | 100.0% |
| 1-B | |
| Iso Bornyl Acetate | 10.0 |
| Lavandin | 15.0 |
| d' Limonene | 20.0 |
| Lemon Oil C.P. | 20.0 |
| 4-Tertiary Butyl Alpha Methyl Hydrocinnamic Aldehyde | 10.0 |
| Methyl Heptine Carbonate | 0.1 |
| Para Cresyl Methyl Ether | 1.0 |
| Anisic Aldehyde | 5.0 |
| Peppermint Oil | 0.5 |
| Phenyl Acetaldehyde Dimethyl Acetal | 2.0 |
| Lauric Aldehyde | 1.0 |
| Iso Hexenyl Cyclohexenyl Carboxaldehyde | 2.0 |
| Methyl Iso Butenyl Tetrahydro Pyran | 0.5 |
| Vetigreen 1% in D.E.P. | 0.1 |

TABLE III-continued

| Perfume Formulas | |
|---|---|
| Component | Weight % |
| Ethyl Methyl Phenyl Glycidate | 0.8 |
| Diphenyl Oxide | 1.0 |
| Musk Xylol | 5.0 |
| Methyl Salicylate | 1.0 |
| 1-8-Cineole | 1.0 |
| Aurantiol | 3.0 |
| Ligustral | 1.0 |
| | 100.0% |

Ethylene glycol and other water-miscible organic nonsolvent liquids can be used to coat the resin in the compositions of this invention. In *Union Carbide's Bulletin* F-42933, May 1970, additional water-miscible "nonsolvents" (organic solvents) which will not significantly solubilize PEO resins at room temperature are disclosed. The *Union Carbide Bulletin* F-42933 is incorporated herein by reference in its entirety. The following list of water-miscible nonsolvents are generally suitable organic liquid coatings for coating the PEO resin compositions of this invention:

| | |
|---|---|
| Toluene | N,N—Dimethylacetamide |
| Xylene | Butanol |
| | Butyl CELLOSOLVE® |
| Acetone | Butyl Acetate |
| CELLOSOLVE Acetate® | Isopropanol, anhydrous |
| Anisole | |
| 1,4-Dioxane | Methyl Isobutyl Ketone |
| Ethyl Acetate | Diethyl CELLOSOLVE® |
| | 1,3-Butanediol |
| Ethylenediamine | Ethyl Ether |
| Dimethyl CELLOSOLVE® | |
| CELLOSOLVE Solvent® | Diethylene Glycol |
| Ethanol, 200 Proof | Glycerine (Glycerol) |
| CARBITOL Solvent® | Pentane |
| | Propylene Glycol |
| | Kerosene |

Mixtures of coating liquid can be used. Cellosolve is a Union Carbide trademark for mono- and dialkyl ethers of ethylene glycol and their derivatives. Carbitol is a trademark for a group of mono- and dialkyl ethers of diethylene glycol and their derivatives.

The ratio of coating liquid to resin in the compositions herein is from about 0.3:1 to about 1.5:1, preferably about 0.3:1 to 1.2:1, and in some embodiments from 0.3:1 to about 0.7:1. The PEO resin must be substantially insoluble in the coating liquid at 25° C. to 50° C., preferably 38° C., and the coated resin/surfactant mixture must be extrudable. This latter requirement restricts the amount of some coating liquids which are useful when employed at lower ratios. Mineral oil, for example, can be employed as a coating liquid in a composition consisting of 12% PEO resin, 6% mineral oil and 82% surfactant (Example 22). However, a composition consisting essentially of 12% PEO, 12% mineral oil and 76% LAS surfactant is not extrudable. So, it will be clear to those skilled in the art, in the light of this disclosure, that some coating liquids which have properties like mineral oil are useful only at the lower ratios and/or lower levels in the composition of this invention. More specifically, when PEO is 12% of the composition, mineral oil or the like cannot be used at ratios over about 0.7:1 without the addition of fumed silica as a processing aid to ensure the extrudability of the composition mixture. Fumed silica is the preferred processing aid to facilitate the extrudability of the compositions of this invention. Silica absorbs excess liquid and can be used at levels of from about zero to about 10% of the weight of composition. Fumed silica is preferably used at a level of less than about 5%. Also a composition comprising a higher level of surfactant (e.g., 85-90%) can permit a composition containing a higher level of coating liquid to be extrudable.

THE SURFACTANT

The third essential component of the composition herein is an organic surfactant. Anionic, nonionic, ampholytic, zwitterionic or cationic surfactants can be used. The surfactant or surfactant mixture must be substantially solid at temperatures up to about 50° C. Anionics and nonionics and mixtures thereof are preferred. Anionics are the most preferred. The surfactant functions as a binder and a carrier. As a binder, the surfactant permits the formulation to be extrudable, which is the preferred method of processing the solid cakes. As a carrier, the surfactant controls the solubility of the PEO resin. The surfactant also dissolves water insolubles in the formulation, particularly water-insoluble perfumes or other water-insoluble nonsolvent coating materials. The surfactant is present in the compositions of this invention at a level of from about 40% to about 93.5%, and preferably from about 55% to about 90%. Compositions comprising higher levels of surfactant permit more flexibility of formulations consisting of higher ratios of coating liquid to resin.

The anionic surfactants can be broadly described as the water-soluble salts, particularly the alkali metal salts, of organic sulfuric acid reaction products having in their molecular structure an alkyl or alkaryl radical contaning from about 8 to about 22 carbon atoms and a radical selected from the group consisting of sulfonic acid and sulfuric acid ester radicals. (Included in the term alkyl is the alkyl portion of higher acyl radicals.) Important examples of the anionic surfactants which can be employed in the practice of the present invention are the sodium or potassium alkyl sulfates, especially those obtained by sulfating the higher alcohols ($C_8$-$C_{18}$ carbon atoms) produced by reducing the glycerides of tallow or coconut oil; sodium or potassium alkyl benzene sulfonates, in which the alkyl group contains from about 9 to about 15 carbon atoms, (the alkyl radical can be a straight or branched aliphatic chain); sodium or potassium alkyl naphthalene sulfonates containing one or two alkyl groups of 1 to about 6 carbon atoms each; paraffin sulfonate surfactants having the general formula $RSO_3M$, wherein R is a primary or secondary alkyl group contaning from about 8 to about 22 carbon atoms (preferably 10 to 18 carbon atoms) and M is an alkali metal, e.g., sodium or potassium; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about 1 to 10 moles of ethylene oxide; sodium or potassium salts of alkyl phenol ethylene oxide ether sulfates with about 1 to about 10 units of ethylene oxide per molecule and in which the alkyl radicals contain from about 8 to about 12 carbon atoms; the reaction product of fatty acids esterified with isethionic acid and neutralized with sodium hydroxide where, for example, the fatty acids are derived from coconut oil; sodium or potassium salts of fatty acid amides of a methyl tauride in which the fatty acids, for example, are derived from coconut oil, and sodium or potassium β-acetoxy- or β-acetamido-alkane-sulfonates where the alkane has from 8 to 22 carbon atoms.

Nonionic surfactants which can be used in practicing the present invention can be of three basic types—the alkylene oxide condensates, the amides and the semi-polar nonionics.

The alkylene oxide condensates are broadly defined as compounds produced by the condensation of alkylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble-compound having the desired degree of balance between hydrophilic and hydrophobic elements.

Examples of such alkylene oxide condensates include:

1. The condensation products of aliphatic alcohols with ethylene oxide. The alkyl chain of the aliphatic alcohol can either be straight or branched and generally contains from about 8 to about 22 carbon atoms. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. Examples of commercially available nonionic surfactants of this type include Tergitol 15-S-9 marketed by the Union Carbide Corporation, Neodol 23-6.5 marketed by the Shell Chemical Company and Kyro EOB marketed by The Procter & Gamble Company.

2. The polyethylene oxide condensates of alkyl phenols. These compounds include the condensation products of alkyl phenols having an alkyl group containing from about 6 to about 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds can be derived, for example, from polymerized propylene, diisobutylene, octene, or nonene. Examples of compounds of this type include nonyl phenol condensed with about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, di-isooctylphenol condensed with about 15 moles of ethylene oxide per mole of phenol. Commercially available nonionic surfactants of this type include Igepal CO-610 marketed by the GAF Corporation; and Triton X-45, X-114, X-100 and X-102, all marketed by the Rohm and Haas Company.

3. The condensation products of ethylene oxide with a hydrophobic base formed by the condensation of propylene oxide with propylene glycol. The hydrophobic portion of these compounds has a molecular weight of from about 1500 to 1800 and of course exhibits water insolubility. The addition of polyoxyethlene moieties of this hydrophobic portion tends to increase the water-solubility of the molecule. Examples of compounds of this type include certain of the commercially available Pluronic surfactants marketed by the Wyandotte Chemicals Corporation.

4. The condensation products of ethylene oxide with the product resulting from the reaction of propylene oxide and ethylene diamine. The hydrophobic base of these products consists of the reaction product of ethylene diamine and excess propylene oxide, said base having a molecular weight of from about 2500 to about 3000. This base is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds marketed by the Wyandotte Chemicals Corporation.

Examples of the amide type of nonionic surfactants include the ammonia, monoethanol and diethanol amides of fatty acids having an acyl moiety of from about 8 to about 18 carbon atoms. These acyl moieties are normally derived from naturally occurring glycerides, e.g., coconut oil, palm oil, soybean oil and tallow, but can be derived synthetically, e.g., by the oxidation of petroleum, or by hydrogenation of carbon monoxide by the Fischer-Tropsch process.

Examples of the semi-polar type of nonionic surfactants are the amine oxides, phosphine oxides and sulfoxides. These materials are described more fully in U.S. Pat. No. 3,819,528, Berry, issued June 25, 1974, and incorporated herein by reference.

Many nonionic surfactants are liquids at ambient temperatures, thus it may be necessary to combine them with solid surfactants in order to formulate them into the solid cake compositions herein.

Ampholytic surfactants which can be used in practicing the present invention can be broadly described as derivatives of aliphatic amines which contain a long chain of about 8 to about 18 carbon atoms and an anionic water-solubilizing group, e.g., carboxy, sulfo and sulfato. Examples of compounds falling within this definition are sodium-3-dodecylamino-propionate, sodium-3-dodecylamino propane sulfonate, and dodecyl dimethylammonium hexanoate.

Zwitterionic surfactants which can be used in practicing the present invention are broadly described as internally-neutralized derivatives of aliphatic quaternary ammonium and phosphonium and tertiary sulfonium compounds, in which the aliphatic radical can be straight chain or branched, and wherein one of the aliphatic substituents contains from about 8 to about 18 carbon atoms and one contains an anionic water-solubilizing group, e.g., carboxy, sulfo, sulfato, phosphato, or phosphono.

Cationic surfactants which can be used in practicing the present invention include stearyl dimethyl benzyl ammonium chloride, coconut dimethyl benzyl ammonium chloride, cetyl pyridinium chloride, and cetyl trimethyl ammonium chloride.

Particularly preferred surfactants for use herein are sodium and potassium alkyl naphthalene sulfonates having one or two alkyl groups containing from 1 to about 6 carbons each, and paraffin sulfonates having the formula $RSO_3M$, wherein R is a primary or secondary alkyl group containing from about 8 to about 22 carbon atoms (preferably about 12 carbon atoms), and M is an alkali metal.

The use of naphthalene sulfonates in the formulation of cake compositions of the type encompassed by the present invention is described in the patent of Choy, entitled "SURFACTANT CAKE COMPOSITIONS", U.S. Pat. No. 4,278,571 issued July 14, 1981, incorporated by reference herein.

OPTIONAL MATERIALS

Various optional materials may be included in the compositions herein.

Dyes may be included at levels of from about 2.5% to 10%. Examples of suitable dyes are Alizarine Light Blue B (C.I. 63010), Carta Blue VP (C.I. 24401), Acid Green 2G (C.I. 42085), Astragon Green D (C.I. 42040), Supranol Cyanine 7B (C.I. 42675), Maxilon Blue 3RL (C.I. Basic Blue 80), Drimarine Blue Z-RL (C.I. reactive Blue 17), Alizarine Light Blue H-RL (C.I. Acid Blue 182), DF&C Blue No. 1 and FD&C Green No. 3. (See the patents of Kitko, U.S. Pat. No. 4,200,606, issued Apr. 29, 1980 and U.S. Pat. No. 4,281,421 issued Aug. 4, 1981, both incorporated by reference herein.) C.I. refers to the Color Index.

Another optional ingredient is "fumed silica" which can be used as a processing aid in an amount needed to absorb excess liquid coating so that the initial composition mixture can be extruded. Fumed silica can be used up to about 10% of the weight of the total composition, but is preferably used at a level of 5% or less.

Another desirable optional ingredient for the compositions herein is an inorganic salt, preferably selected from the water-soluble alkali metal salts and used up to a maximum of about 16% of the total cake composition.

Yet another optional ingredient useful in the practice of the present invention is polyethylene glycol (PEG) having a molecular weight of from about 3,000 to 10,000. PEG added to the formulation of this invention at levels of about 20% to about 40%, preferably 25% to 35%, acts as a dispersing aid. The concentrated solution of the resin/surfactant dispensed into the flush water disperses more quickly. In other words, the resultant solution breaks up faster upon entering the toilet bowl wastewater because of its lower viscosity.

DISPENSING MEANS

Dispensing means which can be used to dispense compositions of the present invention into the toilet flush water are exemplified by those described in U.S. Pat. Nos. 3,831,205, 3,341,074, 3,504,384, 2,688,754, 4,036,407 and 4,171,546; and U.S. Pat. Nos. 4,186,856 and 4,208,747, above noted. A particularly advantageous dispensing means for use with the compositions herein is described in application of Choy entitled "PASSIVE DOSING DISPENSER EXHIBITING IMPROVED RESISTANCE TO CLOGGING", U.S. Ser. No. 153,997 filed May 28, 1980.

Although the cake compositions herein have a low tendency toward gel formation in dispenser designed for use in flush toilet tanks, they nevertheless do form some gel. Accordingly, it is preferable that they be used in a dispensing device which is especially designed to minimize any adverse effects on dispensing which may accompany even small amounts of gel formation by the compositions herein. The above-noted dispenser of Choy is such a device.

CAKE MANUFACTURE AND USE

The manufacture of solid cakes from the compositions of the present invention is well within the capability of persons of ordinary skill in the art of forming bars of toilet soap. The PEO resin/surfactant cakes of the present invention as described herein were manufactured by mixing the raw materials into a homogeneous mass and plodding, extruding. The resin and nonsolvent liquid are preferably mixed before mixing with the surfactant. The extruded log is cut to form uniform bars of cakes sized to fit within the preferred dispensers described as preferred surfactant dispensers in the patent of Wages, U.S. Pat. No. 4,216,027, Aug. 5, 1980, which is herein incorporated by reference.

In a preferred embodiment of the present invention, the PEO resin/surfactant cake composition described above is adapted to be dispensed from a passive dosing dispenser. Such dispensers are described hereinabove. These dispensers are particularly preferred because they contain a cake or cakes of solid ingredients which are exposed to water to form a concentrated cleaning, disinfecting, aerosol control, or aesthetic (hereinafter: concentrate) solution which is kept in isolation from the water of the toilet tank until the toilet is flushed. The preferred dispensers provide a measured quantity of the concentrate to the toilet flush water in order to produce a fairly constant level of the active ingredients within the water of the toilet bowl at all times. In this context, the quantity of concentrate which is released to the toilet is designed so that the cake ingredients are in the toilet bowl at a level of roughly 2 ppm to about 30 ppm.

In a preferred practice of the invention, an oxidizing agent (e.g., a hypochlorite solution) is supplied to the toilet bowl water from a dispensing means separate from that which dispenses the ingredients of the above-described coated PEO resin/surfactant cake. The oxidizing agent is dispensed separately to prevent prolonged contact between high concentrations of the oxidizing agent and the ingredients of the coated PEO resin/surfactant cake prior to their dispensation to the toilet. The oxidizing material may be dispensed in the form of a composition containing other ingredients with which it is compatible, or it may even be present in the water as supplied to the toilet from a public or private water supply; for example, water which has been chlorinated.

Hypochlorite ions may be supplied to the toilet bowl by any of a wide variety of compounds. Specific examples of compounds of this type include sodium hypochlorite, potassium hypochlorite, lithium hypochlorite, calcium hypochlorite, calcium hypochlorite dihydrate, monobasic calcium hypochlorite, dibasic magnesium hypochlorite, chlorinated trisodium phosphate dodecahydrate, potassium dichloroisocyanurate, sodium dichloroisocyanurate, sodium dichloroisocyanurate dihydrate, 1,3-dichloro-5, 5-dimethylhydantoin, N-chlorosulfamide, chloramine T, dichloroamine T, chloroamine B, and dichloramine B. Preferred sanitizing agents are calcium hypochlorite, lithium hypochlorite, and mixtures thereof. A particularly preferred sanitizing agent suitable for use in conjunction with the practice of the present invention is described in the commonly assigned U.S. patent of Nyquist et al., entitled "PASSIVE DOSING DISPENSER WITH IMPROVED HYPOCHLORITE CAKE", U.S. Pat. No. 4,281,421 issued Aug. 4, 1981, said patent being incorporated herein by reference. As indicated in the Nyquist patent, the sanitizing material is compounded into a separate cake which is contacted with toilet tank water in an entirely separate dispenser. The dispenser for the coated PEO resin/surfactant cake and for the hypochlorite cake are desirably molded as a single integral unit, as by thermoforming shells and assembling them as indicated in the Nyquist patent. Means are thus provided to dispense at least 3 ppm (parts per million), preferably about 5 ppm to 10 ppm of available chlorine (in the form of hypochlorite) to the water of a toilet while concurrently dispensing the indicated proportions of the coated PEO resin/surfactant cake of the present invention to the toilet tank water.

DESCRIPTION OF THE DRAWING

The FIGURE shows a preferred dispenser 20, which can be used with the solid cake compositions of the present invention.

Dispenser 20 comprises a front wall 22, a back wall 23, sidewall segments 25, 26, 31, 50, 51, 52 and 90, a top wall 28, bottom wall segments 29, 53 and 54, interior partitions 32, 55, 56, 57, 58, 91, 95 and 96, and solid product support members 33. The solid product support members 33 are of lesser thickness than the width of the dispenser wall segments to ensure that liquid can wash across the lowermost surface of solid product 21 along its entire length. The walls and partitions are rigid and define a liquid solution reservoir 65, a solid product chamber 69, a syphon tube 44 having uppermost vertical passageways 85 and 86, a horizontal passageway 87, a vertical passageway 88 connecting with inlet/discharge conduit 80, said inlet/discharge conduit having an air trap 81 disposed adjacent thereto, and vent means for the product chamber comprising passageways 71 and 72 and air vent 83. The lowermost edge of partition segment 58 is designated 59, the lowermost edge of partition segment 96 is designated 67, the exposed edge of bottom wall segment 29 is designated 61, the lowermost edge of level control partition 32 is designated 62, the uppermost edge of sidewall segment 31 is designated 93, and the lowermost edge of sidewall segment 26, which in conjunction with front and back walls 22 and 23, respectively, and sidewall segment 31 define air vent 83, is designated 64. The inlet/discharge port of dispenser 20 located at the lowermost end of syphon tube 44 is designated 78.

In the case of dispenser 20, the lowermost portion of product chamber 69 coincides with bottom wall segment 29. Liquid solution reservoir 65 and product chamber 69 together comprise what is hereinafter collectively referred to as an internal reservoir.

The invention herein will be illustrated by the following examples, but is not limited thereto.

EXAMPLE 1

A preferred composition of the present invention was prepared according to the following preferred procedure:

1. A pine fragrance perfume was mixed by hand with Polyox C®. After thorough mixing, fumed silica was added to the mixture to make it more free-flowing.

2. The surfactant, linear alkylbenzene sulfonate, Calsoft F-90®, and dye, FD&C Blue #1, were then added to the mixture made in step 1 and mixed to form a homogeneous mass.

3. This mass was then extruded from a single screw plodder[5] through a tapered nozzle heated with heat tape so that the extruded log came out at a temperature of about 38° C. to about 42° C. The resulting log (4.9 cm × 1.3 cm) was cut into 6.5 cm length cakes.

| | |
|---|---|
| Polyox C[1] | 12.0% |
| Calsoft F-90[2] | 72.0% |
| Perfume[3] | 10.6% |
| FD&C Blue #1 dye | 3.4% |
| Fumed Silica[4] | 2.0% |

[1]polyethylene oxide resin, M.W. 5,000,000.
[2]surfactant, linear alkylbenzene sulfonate (LAS).
[3]a pine fragrance perfume.*
[4]added as a flow aid.
[5]plodder barrel chilled to a temperature of about −3° C.
*See Table III, 1-A and 1-B.

A cake from this example was placed in a dispensing device of the general type described in the drawing and application of Choy U.S. Ser. No. 153,997 filed May 28, 1980. The dispensing device was then suspended in the flush tank of a toilet by means of a hanger device described in the patent of Dirksing, U.S. Pat. No. 4,247,070 issued Jan. 27, 1981. The composition performed satisfactorily in the device in that proper quantities of the compositions were repeatedly delivered to flush water during the flushing of the toilet. No appreciable gelling was observed.

The performance of the above composition was further evaluated by suspending a dispensing device containing the cake composition in a plexiglass tank which was automatically flushed on a set 14 flushes/day schedule. The longevity of the cake composition was evaluated regularly by measuring the height of the cake remaining inside the dispensing device. A fairly linear reduction in plug height indicated that the dissolution of the cake material was fairly equal over the life of the cake. The product did not gel excessively and satisfactory performance was achieved for about 4 weeks.

Other formulations of the composition of this invention are set out in the table entitled Examples 2–22.

Cakes were prepared and tested using the procedures of Example 1 except that the perfumes 1-A and 1-B of Table III were used in place of the pine fragrance perfume. The performances of Example 1, 1-A and 1-B were substantially equivalent.

EXAMPLES 2–22

All components expressed in weight % and the coating liquid (CL) is a pine fragrance perfume unless otherwise specified.

| Ex. | % PEO | % CL | % Silica | % LAS | % Blue Dye | % NaCl |
|---|---|---|---|---|---|---|
| 2 | 8.0 | 10.6 | 2.0 | 74.3 | 5.1 | — |
| 3 | 8.0 | 10.6 | 2.0 | 66.3 | 5.1 | 8.0 |
| 4 | 8.0 | 10.6 | 2.0 | 79.4 | — | — |
| 5 | 12.0 | 10.6 | 2.0 | 70.3 | 5.1 | — |
| 6 | 8.0 | 10.6 | 2.0 | 74.3 | 5.1 | — |
| 7 | 8.0 | 10.6 | 2.0 | 66.3 | 5.1 | 8.0 |
| 8 | 12.0 | 10.6 | 2.0 | 70.3 | 5.1 | — |
| 9 | 8.0 | 10.6 | 2.0 | 79.4 | — | — |
| 10 | 8.0 | 10.6 | 2.0 | 74.3 | 5.1 | — |
| 11 | 8.0 | 10.6 | 2.0 | 69.3* | 5.1 | 5.0 |
| 12 | 8.0 | 10.6 | — | 76.3 | 5.1 | — |
| 13 | 8.0 | 10.6 | 2.0 | 76.0 | 3.4 | — |
| 14 | 8.0 | 10.6 | 2.0 | 74.3 | 5.1 | — |
| 15 | 8.0 | 10.6 | 2.0 | 66.3 | 5.1 | 8.0 |
| 16 | 12.0 | 10.6 | 2.0 | 75.4 | — | — |
| 17 | 12.0 | 10.6 | 2.0 | 72.0 | 3.4 | — |
| 18 | 12.0 | 10.6 | 2.0 | 72.0 | 3.4 | — |
| 19 | 8.0 | 10.6 | 2.0 | 68.0 | 3.4 | 8.0 |
| 20 | 16.0 | 10.6 | 2.0 | 68.0 | 3.4 | — |
| 21 | 12.0 | 11.0** | 2.0 | 75.0 | — | — |

-continued

| Ex. | % PEO | % CL | % Silica | % LAS | % Blue Dye | % NaCl |
|---|---|---|---|---|---|---|
| 22 | 12.0 | 6.0*** | — | 82.0 | — | — |

*Surfactant is 50/50: LAS/AS alkyl sulfate ($C_{12}$)
**Ethylene glycol
***Mineral oil Using the procedure of Example 1, cakes made from the compositions of Examples 2–22 were placed in automatic dispensing devices of the general type described in the drawing and the application of Choy, U.S. Ser. No. 153,997, filed May 28, 1980. They were tested in the plexiglass flush tank described in Example 1, using a hanger device of the type described in Example 1. All cake compositions of Examples 1–22 repeatedly delivered metered amounts of chemicals to the flush water without gelling interference.

Examples 23, 24, and 25 show the formulations of solid cake compositions made from Polyox C® (PEO resin, M.W. 5,000,000); pine cone fragrance perfume (CL); Calsoft F-90 linear alkylbenzene sulfonate (LAS); polyethylene glycol (PEG-8000); and FD&C Blue #1 Dye.

EXAMPLES 23–25

| EX | PEO | CL | LAS | PEG | DYE | NaCl |
|---|---|---|---|---|---|---|
| 23 | 8 | 10.6 | 40 | 30 | 3.4 | 8 |
| 24 | 8 | 9 | 55.1 | 25 | 2.9 | — |
| 25 | 8 | 9 | 50.1 | 30 | 2.9 | — |

Homogeneous mixtures of the above formulations were prepared and extruded (38° C.) into logs which were cut into cakes the same as in Example 1. The cake matrices were tested the same as Examples 1–22 and no significant gelling was observed. Also, little or no unsightly blue strings of the dispensed solution were observed in the flush water.

What is claimed is:

1. A solid cake composition comprising a matrix of the following components:

A. from about 5% to about 20% of a polyethylene oxide resin having a molecular weight of from about 500,000 to about 7,000,000;

B. from about 1.5% to about 30% of a nonsolvent coating liquid in a weight ratio of from about 0.3:1 to about 1.5:1 of said coating liquid to said resin;

C. from about 40% to about 93.5% of a synthetic surfactant which is substantially solid at about 25° C. to about 50%;

wherein said coating liquid does not significantly solubilize said resin at a temperature of about 25° C. to about 50° C.; and wherein the resin when mixed with said coating liquid is free-flowing; and wherein said cake is made from a homogeneous mass of said A., B., and C.; and wherein said homogeneous mass is extrudable at said temperature.

2. The composition of claim 1 wherein said resin is present at a level of from about 8% to about 16% and said surfactant is present at a level of from about 55% to about 90%.

3. The composition of claim 2 wherein the ratio of coating liquid to resin in said composition is from about 0.3:1 to about 1.2:1.

4. The composition of claim 2 wherein the ratio of coating liquid to resin in said composition is from about 0.3:1 to about 1:1.

5. The composition of claim 2 wherein the ratio of coating liquid to resin in said composition is from about 0.3:1 to about 0.7:1.

6. The composition of claim 1, 2, 3, 4, or 5 wherein the coating liquid is selected from the group consisting of perfume, liquid oils, water-miscible organic liquids and mixtures thereof.

7. The composition of claims 1, 2, 3, 4, or 5 wherein said coating liquid is a perfume.

8. The composition of claim 7 wherein surfactant is a surfactant selected from the group consisting of anionic and nonionic surfactants, and mixtures thereof.

9. The composition of claim 8 wherein the surfactant is an anionic surfactant.

10. The composition of claim 9 wherein the surfactant is linear alkylbenzene sulfonate containing an alkyl radical with about 9 to about 15 carbon atoms.

11. The composition of claim 1, 2, 3, 4, or 5 wherein said composition contains from about zero to about 10% fumed silica.

12. A method of making an improved polyethylene oxide cakes with reduced gelling for flush toilet wastewater sanitation, said method comprising the following steps:

1. Forming a free-flowing mixture of:
   A. from about 5% to about 20% of a polyethylene oxide resin having a molecular weight of from about 500,000 to about 7,000,000; and
   B. from about 1.5% to about 30% of a nonsolvent coating liquid in a weight ratio of from about 0.3:1 to about 1.5:1 of said coating liquid to said resin;
2. Forming an extrudable homogeneous mass of said free-flowing resin (1) and from about 40% to about 93.5% of a synthetic surfactant which is substantially solid at about 25° C. to about 50° C.;
3. Extruding the homogeneous mass (2) into bars of desired size; and
4. Cutting said bars (3) into said cakes of desired size; wherein said coating liquid does not significantly solubilize said resin at said temperature and said ratio.

13. The invention of claim 12 wherein said resin is present at a level of from about 8% to about 16% and said surfactant is present at a level of from about 55% to about 90%.

14. The invention of claim 13 wherein said ratio in said cake is from about 0.3:1 to about 1.2:1.

15. The invention of claim 14 wherein the ratio of coating liquid to resin in said cake is from about 0.3:1 to about 1:1.

16. The invention of claim 15 wherein the ratio of coating liquid to resin in said cake is from about 0.3:1 to about 0.7:1.

17. The invention of claim 12, 13, 14, 15, or 16 wherein the coating liquid is selected from the group consisting of perfume, liquid oils, water-miscible organic liquids and mixtures thereof.

18. The invention of claim 12, 13, 14, 15, or 16 wherein said coating liquid is a perfume.

19. The invention of claim 18 wherein said surfactant is a surfactant selected from the group consisting of anionic and nonionic surfactants, and mixtures thereof.

20. The invention of claim 19 wherein the surfactant is an anionic surfactant.

21. The invention of claim 20 wherein the surfactant is linear alkylbenzene sulfonate containing an alkyl radical with about 9 to about 15 carbon atoms.

22. The invention of claim 12 wherein the composition contains from about zero to about 10% fumed silica.

* * * * *